United States Patent [19]

Fisher

[11] 4,255,649

[45] Mar. 10, 1981

[54] FLEXIBLE HEATING ELEMENTS

[76] Inventor: Joseph Fisher, 52 Southover, Daisy Hill, Westhoughton, Bolton, Lancashire, England

[21] Appl. No.: 79,060

[22] Filed: Sep. 26, 1979

[30] Foreign Application Priority Data

Sep. 29, 1978 [GB] United Kingdom ..... 38749/78

[51] Int. Cl.[3] ..... H05B 3/02

[52] U.S. Cl. ..... 219/550; 174/138 J; 219/532; 219/539; 219/549; 338/213

[58] Field of Search ..... 219/532, 539, 542, 549, 219/476, 550, 551, 552; 174/138 J; 338/212, 213, 214, 217, 316

[56] References Cited

U.S. PATENT DOCUMENTS

| | | | |
|---|---|---|---|
| 1,855,092 | 4/1932 | Browne | 219/550 X |
| 3,036,187 | 5/1962 | Goldstaub et al. | 219/539 |
| 3,045,097 | 7/1962 | Sellers | 219/539 |
| 3,694,628 | 9/1972 | McGwire et al. | 219/550 |
| 3,806,706 | 4/1974 | Lodge | 219/550 |

FOREIGN PATENT DOCUMENTS

| | | | |
|---|---|---|---|
| 819928 | 10/1937 | France | 219/550 |
| 13390 | 4/1904 | Norway | 219/550 |
| 813508 | 5/1959 | United Kingdom | 219/550 |
| 1415002 | 11/1975 | United Kingdom | 219/550 |

*Primary Examiner*—Volodymyr Y. Mayewsky

*Attorney, Agent, or Firm*—Laurence R. Brown

[57] ABSTRACT

A heating element comprising a plurality of ceramic components strung together on a heating wire to form a flexible structure, adjacent ceramic components comprising integrally formed mating projections and depressions. The element comprises ceramic components of a first type each having a body defining two generally parallel passages therethrough, both passages terminating at one end in a common slot, one passage terminating at the other end in a depression, and the other passage terminating at the other end in a projection; and ceramic components of a second type having a body defining a passage therethrough terminating at one end in a depression and at the other end in a projection, the components of the first type forming two parallel rows, the components of the two rows being staggered relative to each other, and the components of the second type being arranged to fill spaces formed at the ends of the two relatively staggered rows such that the two rows of components are of substantially the same length and each passage in one row is aligned with a respective passage in the other row, the components being oriented such that the projections and depressions of adjacent rows interengage, and the wire being arranged to pass through the passages in each component and to lie in the slots in the components of said first type. .

9 Claims, 13 Drawing Figures

FLEXIBLE HEATING ELEMENTS

Figure 1:
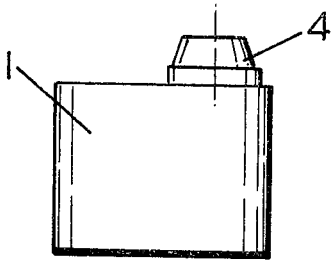

The present invention relates to flexible heating elements.

Flexible heating elements are known which comprise a series of ceramic blocks strung onto a heating wire. A heating element of considerable surface area can be obtained by arranging the heating wire such that it follows a circuituous path through a series of ceramic blocks. A flexible mat-like structure held together by the heating wire results.

British Patent Specification No. 893,125 describes a heating element in which small ovoid ceramic beads are arranged on the wire between adjacent blocks to improve flexibility without exposing the wire. The small beads do indeed improve flexibility but they cause handling difficulties during manufacture or subsequent modification to the heating element. To avoid these handling difficulties British Patent Specification No. 1,415,002 proposes the use of blocks having bead-shaped projections formed integrally therewith to provide the desired improved flexibility without using small ceramic components. The system described in British Pat. specification No. 1,415,002 does however require the provision of four different types of ceramic block to enable the assembly of generally rectangular heating elements and this increases the costs involved in obtaining, storing and assembling the ceramic components. In contrast, the system according to British Pat. specification No. 893,125 requires only three different ceramic components including the small beads. Narrow heating elements having only two rows of ceramic components can in fact be fabricated from only three of the components described in British Pat. specification No. 1,415,002, but such narrow elements can be fabricated from only two of the components described in British Pat. specification No. 893,125.

It is an object of the present invention to provide a heating element which can be manufactured easily from a minimum number of ceramic components.

According to the present invention, there is provided a heating element comprising a plurality of ceramic components strung together on a heating wire to form a flexible structure, adjacent ceramic components comprising integrally formed mating projections and depressions, characterised in that the element comprises ceramic components of a first type each having a body defining two generally parallel passages therethrough, both passages terminating at one end in a common slot, one passage terminating at the other end in a depression, and the other passage terminating at the other end in a projection; and ceramic components of a second type having a body defining a passage therethrough terminating at one end in a depression and at the other end in a projection, the components of the first type forming two parallel rows, the components of the two rows being staggered relative to each other, and the components of the second type being arranged to fill spaces formed at the ends of the two relatively staggered rows such that the two rows of components are of substantially the same length and each passage in one row is aligned with a respective passage in the other row, the components being oriented such that the projections and depressions of adjacent rows interengage, and the wire being arranged to pass through the passages in each component and to lie in the slots in the components of said first type.

Preferably, the heating element also comprises ceramic components of a third type each having a body defining two generally parallel passages therethrough, each passage terminating at one end in a projection and at the other end in a depression, and the projection of one passage being located on the same side of the body as the depression of the other passage, wherein the components of said third type are arranged in at least one row located between the said two parallel rows, the components of each pair of adjacent rows being positioned relative to each other so that said passages are aligned, and the components of the second type being arranged to fill spaces formed at the ends of the relatively staggered rows such that a generally rectangular structure results, the components being oriented such that the projections and depressions of adjacent rows interengage, and the wire being arranged to pass through the passages in each component and to lie in the slots in the components of said first type.

It will be appreciated that a double row element can be manufactured using only two types of ceramic component, and a three or more row element can be manufactured using only three types of ceramic component.

When the element is assembled the interengaged projections and depressions can more relative to each other to enable the element to bend. The element can thus be fitted in close contact with for example curved surfaces.

Figure 2:
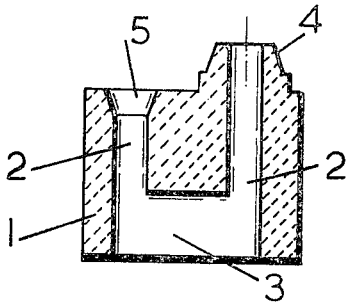
Figure 3:
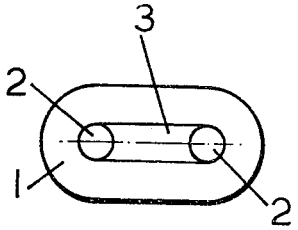
Figure 4:
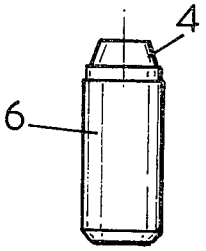
Figure 5:
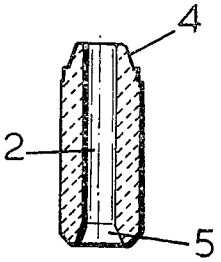
Figure 6:
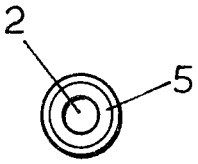
Figure 7:
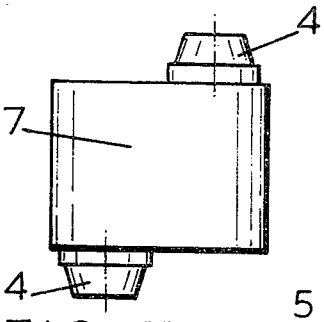
Figure 8:
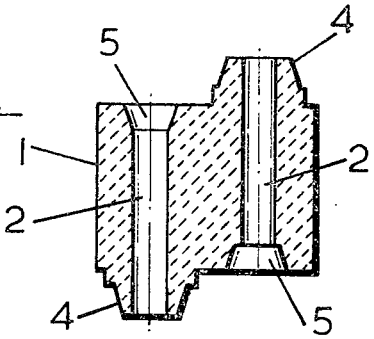
Figure 9:
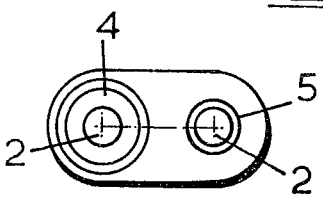

Embodiments of the present invention will now be described, by way of example, with reference to the accompanying drawings, in which:

FIGS. 1, 2 and 3 respectively show side, side sectional and bottom end views of a first ceramic component;

FIGS. 4, 5 and 6 respectively show side, side sectional and bottom end views of a second component;

FIGS. 7, 8 and 9 respectively show side, side sectional and bottom end views of a third component used in the element of FIG. 1; and FIGS. 10 to 13 show four embodiments of the invention manufactured from components as shown in FIGS. 1 to 9.

Referring to FIGS. 1 to 3, the illustrated ceramic body 1 is of a first type which comprises two passages 2 each of which terminates at one end in a common slot 3 and at the other end in a projection 4 or a depression 5. The projection 4 and depression 5 have matching frusto-conical axial sections.

Referring to FIGS. 4 to 6, the illustrated ceramic body 6 is of a second type which comprises a single passage 2 extending between a projection 4 and a depression 5.

Referring to FIGS. 7 to 9, the illustrated ceramic body 7 is of a third type which comprises two passages 2, each terminating at one end in a projection 4 and at the other end in a depression 5. The projection 4 of one passage 2 is located on the same side of the body as the depression 5 of the other passage 2.

Figure 10:
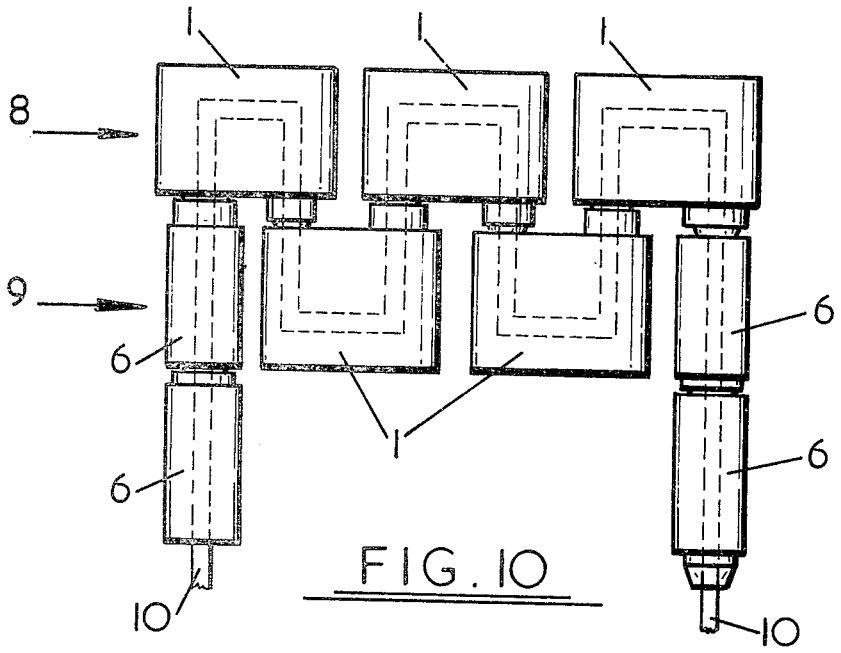

Referring now to FIG. 10, the illustrated embodiment of the invention comprises a row 8 of three members 1 of the first type (FIGS. 1 to 3), and a row 9 made up from two members 6 of the second type (FIGS. 4 to 6) and two members 1 of the first type. Thus the members 1 of the two rows 8 and 9 are staggered relative to each other, and the members 6 fill spaces at the ends of the row 9 which result from the fact that the row 8 has one more member 1 than the row 9. A wire 10 is passed via two further lead in members 6 along the path indicated by dotted lines.

Figure 11:
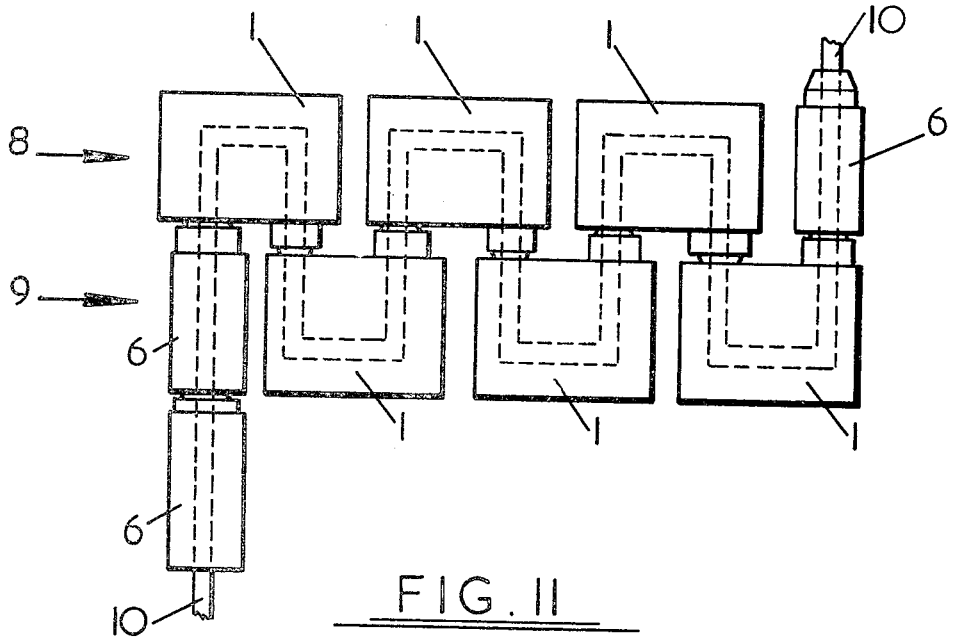

Referring to FIG. 11, an alternative two row heating element is illustrated. This element is similar to that of FIG. 10 but row 8 has an extra member 6 and row 9 has an extra member 1 but only one member 6. The resulting structure differs from that of FIG. 10 in that the two ends of the wire 10 are fed in from opposite sides rather than from the same side.

The embodiments of the invention illustrated in FIGS. 10 and 11 which comprise only two rows of ceramic bodies are known as cross wound snake heaters. It will be noted that these embodiments are fabricated from only two types of ceramic bodies. Generally however it is desired to provide heating elements of greater width, and FIGS. 12 and 13 illustrate embodiments of the invention the basic structure of which enables the production of heating elements of any rectangular shape.

Figure 12:
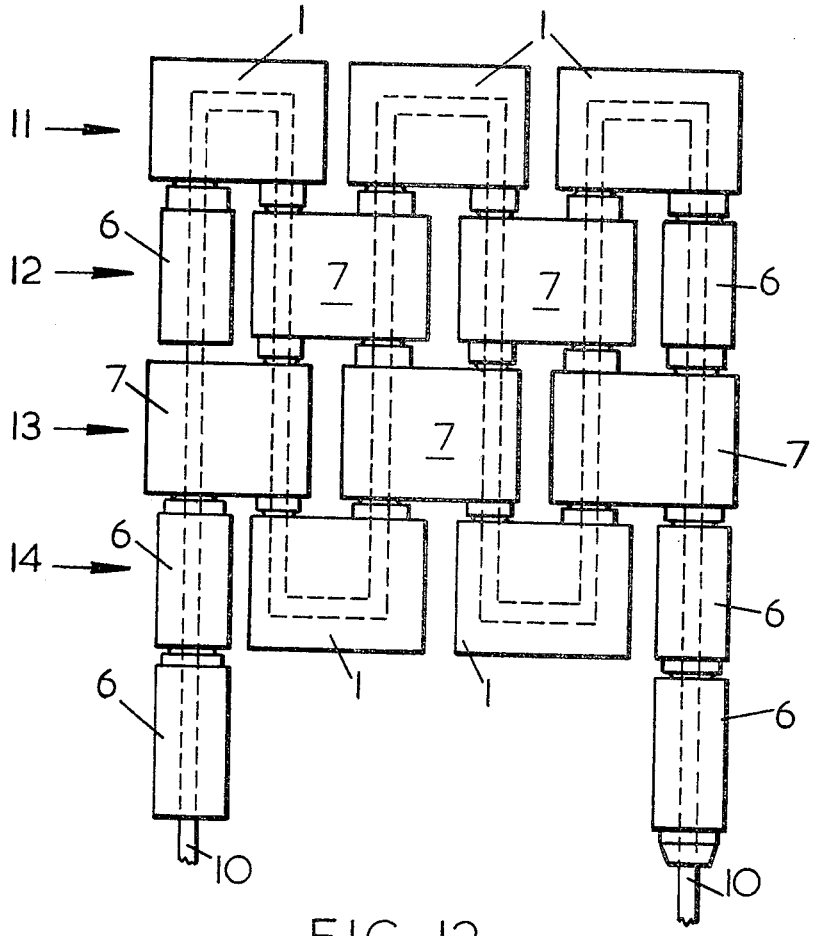

Referring to FIG. 12, the illustrated element comprises a row 11 of three members 1 of the first type, a row 12 of two members 7 of the third type (FIGS. 7 to 9) and two members 6 of the second type, a row 13 of three members 7 of the third type, and a row 14 of two members 1 of the first type and two members 6 of the second type. Two further members 6 of the second type serve for leading in the wire 10. It will be noted that the members 6 of the second type in rows 12 and 14 fill in gaps in a rectangular array formed by the members 1 and 7. The structure of FIG. 12 may be expanded simply by adding a member 1 of the first type to rows 11 and 14 and a member 7 of the third type to rows 12 and 13, or by adding pairs of rows corresponding to rows 12 and 13. FIG. 12 is thus illustrative of any element having an even number of rows of the members of the third type.

Figure 13:
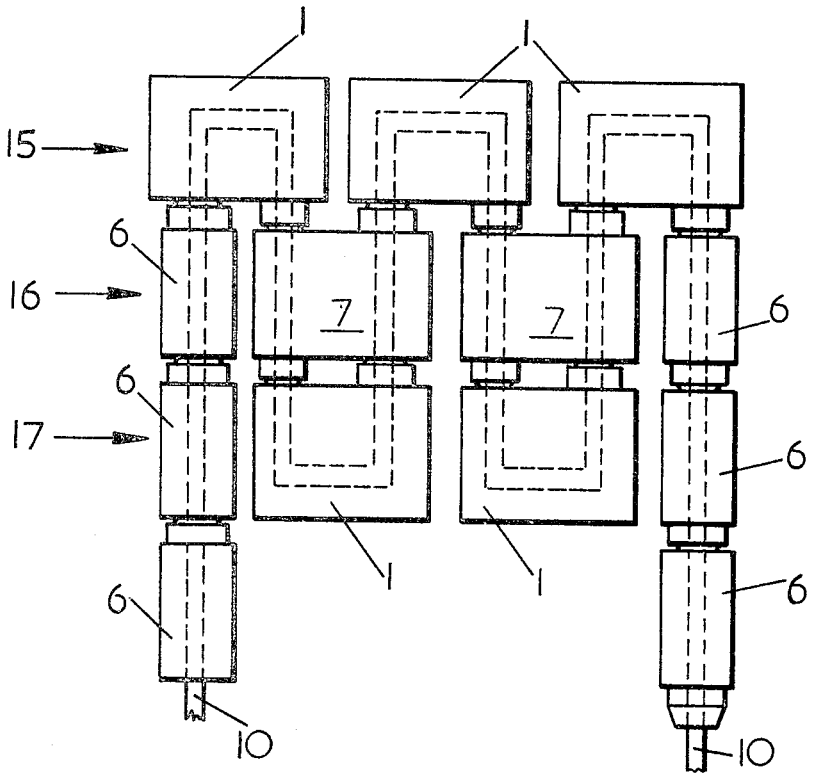

Referring to FIG. 13, the illustrated element comprises a row 15 of three members 1 of the first type, a row 16 of two members 7 of the third type and two members 6 of the second type, and a row 17 of two members 1 of the first type and two members 6 of the second type. Two further members 6 of the second type serve for leading in the wire 10. It will again be noted that the members 6 in rows 16 and 17 fill in gaps in a rectangular array formed by the members 1 and 7. The structure of FIG. 13 may be expanded simply by adding a member 1 to rows 15 and 17 and a member 7 to row 16, or by adding pairs of rows corresponding to a row of three members 7 and a row such as row 16. FIG. 13 is thus illustrative of any element having an odd number of rows of the members of the third type.

The interengagement of the projections and depressions in the assembled elements may be seen from FIGS. 10 to 13. Assembly is a simple matter not only because at most only three ceramic components are used, but also because the wire can be threaded through each component by always inserting the wire into the appropriate passage from its depression end. Thus the element of FIG. 12 can be assembled by threading the wire through the components in the following order starting at the left hand bottom corner of FIG. 12: 6,6,7,6,1,7,7,1,7,7,1,7,7,1,7,7,1,6,7,6,6. Therefore it is not necessary to think about the orientation of the individual components. Providing the components are selected in the correct order, the assembler merely inserts the wire into the depression end of a passage in the selected component and the correct orientation results automatically.

It will be appreciated that the use of a jig to hold the ceramic bodies will facilitate the insertion of the wire.

It will be appreciated that elements other than these illustrated in FIGS. 10 to 13 may be manufactured from the components of FIG. 1 to 9. It will also be appreciated that the shapes of the ceramic components may if desired differ from those illustrated. For example, the projections and depressions may be part-spherical rather than frusto-conical in axial section.

I claim:

1. A heating element comprising a plurality of ceramic components strung together on a heating wire to form a flexible structure, adjacent ceramic components comprising integrally formed mating projections and depressions, characterised in that the element comprises ceramic components of a first type each having an integral body defining two generally parallel passages therethrough, both passages in said integral ceramic body terminating at one end in a common slot, one passage terminating at the other end in a depression formed in said ceramic body, and the other passage terminating at the other end in a projection extending integrally from said ceramic body; and ceramic components of a second type having an integral ceramic body defining a passage therethrough terminating at one end in a depression and at the other end in a projection, the components of the first type forming two parallel rows, the components of the two rows being staggered relative to each other, and the components of the second type being arranged to fill spaces formed at the ends of the two relatively staggered rows such that the two rows of components are of substantially the same length and each passage in one row is aligned with a respective passage in the other row, the components being oriented such that the projections and depressions of adjacent rows interengage, and the wire being arranged to pass through the passages in each component and to lie in the slots in the components of said first type.

2. A heating element according to claim 1, comprising ceramic components of a third type each having an integral ceramic body defining two generally parallel passages therethrough, each passage terminating at one end in a projection and at the other end in a depression, and the projection of one passage being located on the same side of the body as the depression of the other passage, wherein the components of said third type are arranged in at least one row located between the said two parallel rows, the components of each pair of adjacent rows being positioned relative to each other so that said passages are aligned, and the components of the second type being arranged to fill spaces formed at the ends of the relatively staggered rows such that a generally rectangular structure results, the components being oriented such that the projections and depressions of adjacent rows interengage, and the wire being arranged to pass through the passages in each component and to lie in the slots in the components of said first type.

3. A heating element according to claim 1, comprising two adjacent rows of components of said first type, one row comprising one less component of said first type than the other and being terminated at each end by a component of said second type.

4. A heating element according to claim 1, comprising two adjacent rows of components of said first type, each row comprising equal numbers of said components of said first type, each of the two adjacent rows being terminated at one end by a component of said second type.

5. A heating element according to claim 2, comprising an even number of rows of components of said third type.

6. A heating element according to claim 2, comprising an odd number of rows of components of said third type.

7. A heating element according to any preceding claim, wherein each projection is frusto-conical in axial section.

8. A heating element comprising a plurality of ceramic components strung together on a single length of flexible heating wire to form a flexible structure which can conform to the shape of curved surfaces and having a plurality of substantially parallel rows of wire passing through and entirely within passages in the ceramic components, the components comprising at least one end of a wire row unit type with an integral ceramic body having two generally parallel passages therethrough, both terminating at one end in a common open ended slot defined by the body into which the heating wire is threaded and held within the slot at the end of a wire row in a generally U-shaped configuration to form a lateral link between said parallel rows of wire extending through said parallel passages, and said ceramic body terminating at the other end in a respective depression and projection integrally formed by the ceramic body for mating into corresponding ceramic bodies having similar integral depression and projection structure further covering the wire passing along said parallel rows of wire.

9. A heating element as defined in claim 8 wherein the heating element has only two rows of ceramic bodies of the type defined in claim 8 with the wire in a cross wound snake configuration.

* * * * *